US007680665B2

(12) United States Patent
Shigyo et al.

(10) Patent No.: US 7,680,665 B2
(45) Date of Patent: Mar. 16, 2010

(54) DEVICE AND METHOD FOR INTERPOLATING FREQUENCY COMPONENTS OF SIGNAL ADAPTIVELY

(75) Inventors: Norihisa Shigyo, Kunitachi (JP); Norikazu Tanaka, Kiyose (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 951 days.

(21) Appl. No.: 10/486,580

(22) PCT Filed: Aug. 24, 2001 (Under 37 CFR 1.47)

(86) PCT No.: PCT/JP01/07256

§ 371 (c)(1), (2), (4) Date: Sep. 23, 2004

(87) PCT Pub. No.: WO03/019533

PCT Pub. Date: Mar. 6, 2003

(65) Prior Publication Data

US 2005/0117756 A1 Jun. 2, 2005

(51) Int. Cl.
*G10L 13/02* (2006.01)

(52) U.S. Cl. ..... 704/265; 704/205; 704/206

(58) Field of Classification Search ..... 704/205, 704/265

See application file for complete search history.

(56) References Cited

U.S. PATENT DOCUMENTS 5,105,463 A * 4/1992 Veldhuis et al. ..... 704/200.1
5,303,374 A * 4/1994 Mitsuhashi et al. ..... 704/212
5,680,508 A * 10/1997 Liu ..... 704/227
5,749,073 A * 5/1998 Slaney ..... 704/278

(Continued)

FOREIGN PATENT DOCUMENTS

JP 02-079549 3/1990

(Continued)

OTHER PUBLICATIONS

Notification of Reason for Refusal for JP Application No. 2003-522910 dated May 9, 2007.

(Continued)

*Primary Examiner*—Richemond Dorvil
*Assistant Examiner*—Leonard Saint Cyr
(74) *Attorney, Agent, or Firm*—Eric J. Robinson; Robinson Intellectual Property Law Office, P.C.

(57) ABSTRACT

A frequency interpolating device for restoring a signal similar to the original signal by creating a suppressed frequency component of a specific frequency band of the original signal, approximately from the input signal having the suppressed frequency component. In the frequency interpolating device, when the suppressed frequency component is artificially created from the input signal and added to the input signal, the additional level is set dynamically and adaptively on the basis of the spectrum pattern of the remaining frequency component of the input signal. This setting of the addition level is done by searching a look-up table which stores data that causes a plurality of reference frequency spectrum patterns to be associated with predetermined addition levels. Moreover, the data stored in the table is created on the basis of the results of either an aural test on a plurality of signal sample sounds or a physical frequency analysis on the massive signal data.

2 Claims, 10 Drawing Sheets

U.S. PATENT DOCUMENTS

| | | | | |
|---|---|---|---|---|
| 5,890,108 | A * | 3/1999 | Yeldener | 704/208 |
| 6,073,093 | A * | 6/2000 | Zinser, Jr. | 704/220 |
| 6,115,684 | A * | 9/2000 | Kawahara et al. | 704/203 |
| 6,377,916 | B1 * | 4/2002 | Hardwick | 704/208 |
| 6,507,820 | B1 * | 1/2003 | Deutgen | 704/500 |
| 6,680,972 | B1 * | 1/2004 | Liljeryd et al. | 375/240 |
| 7,151,802 | B1 * | 12/2006 | Bessette et al. | 375/259 |

FOREIGN PATENT DOCUMENTS

| | | |
|---|---|---|
| JP | 05-300019 | 11/1993 |
| JP | 06-085607 | 3/1994 |
| JP | 06-188663 | 7/1994 |
| JP | 07-093900 | 4/1995 |
| JP | 07-202819 | 8/1995 |
| JP | 09-023127 | 1/1997 |
| JP | 10-117115 | 5/1998 |
| JP | 10-124088 | 5/1998 |
| JP | 2000-183834 | 6/2000 |
| JP | 2000-187492 | 7/2000 |

OTHER PUBLICATIONS

International Search Report, Nov. 6, 2001.

* cited by examiner (a)

FIG. 7

| NO. | REFERENCE SPECTRUM ($d_1, d_2, d_3, \cdots\cdots, d_N$) | INTERPOLATION LEVEL (g) |
|---|---|---|
| 1 | (0.8, 0.5, 0.4, .... 0.1) | 0 |
| 2 | (0.5, 0.2, 0.3, .... 0.5) | 0.5 |
| 3 | (0.7, 0.3, 0.4, .... 0.2) | 0.2 |
| 4 | (0.5, 0.7, 0.3, .... 0.4) | 0.1 |
| ⋮ | ⋮ | ⋮ |
| 51 | (0.6, 0.3, 0.7, .... 0.1) | 1 |
| 52 | (0.8, 0.9, 0.3, .... 0.5) | 0.3 |
| ⋮ | ⋮ | ⋮ |
| M | (0.8, 0.7, 0.5, .... 0.1) | 0.4 |

(a)

(b)

(a)

(b)

α →

β ↓

| | | | | |
|---|---|---|---|---|
| 0 | 1 | 0.5 | ------ | 0.6 |
| 0.3 | 0.2 | 0.3 | ------ | 0.7 |
| 0.2 | 0.3 | 0 | ------ | 0.4 |
| 0.5 | 1 | 0.4 | ------ | 0.5 |
| ⋮ | ⋮ | ⋮ | ⋮ | ⋮ |
| 0.4 | 1 | 0.8 | ------ | 0.5 |

(a)

(b)

DEVICE AND METHOD FOR INTERPOLATING FREQUENCY COMPONENTS OF SIGNAL ADAPTIVELY

TECHNICAL FIELD

The present invention relates to a frequency interpolating device and method for improving the spectrum distribution of a signal having the frequency components in a particular frequency band being removed or suppressed, by recovering the frequency components in the particular frequency band as approximate values and adaptively interpolating the approximate values into the signal.

BACKGROUND ART

Supply of music and the like is flourishing nowadays by means of data distribution by MP3 (MPEG1 audio layer 3), FM (Frequency Modulation) broadcasting, voice multiplexing broadcasting and the like. With these means, a data transmission rate (bit/s) changing proportionally with a frequency bandwidth is lowered and the upper frequency limit is lowered by suppressing the high frequency components of a subject audio signal or the like in order to avoid an occupied broad bandwidth and effectively use radio wave resources. For example, if the upper frequency limit is lowered by suppressing the frequency components at about 15 kHz or higher of an audio signal having the upper limit frequency of 20 kHz, the sampling frequency is only ¾ of the original signal frequency so that the data transmission rate can be lowered advantageously. However, it is obvious that an audio signal with suppressed high frequency components has a sound quality inferior to that of the original signal. From this reason, it has been tried to recover approximate suppressed frequency components by some means. In one approach to recover frequency components, a subject signal is distorted to obtain a distorted signal, the frequency band components to be interpolated into the suppressed band are derived from the distorted signal by using a filter, and the frequency band components are added to the target signal to reproduce a signal approximated to the original signal.

In another approach, voice components containing a pair of a fundamental tone and a harmonic tone are derived from an original audio signal, harmonic components on the high frequency side are estimated from the bandwidth of the original audio signal, and the estimated harmonic components are extrapolated relative to the original audio signal.

With the former approach, however, since the waveform of an audio signal is distorted by using a limiter circuit or the like to create harmonics, these harmonics are not necessarily approximate values essentially contained in the original audio signal.

If the latter approach is applied to an original audio signal whose bandwidth of voices or the like was limited, harmonic components of pure sound components cannot be estimated so that extrapolation is impossible. Similarly, sound components whose harmonic components were removed because of a limited bandwidth cannot be estimated and extrapolation is impossible.

In a relatively good approach, a target signal is frequency analyzed, its frequency spectrum pattern is used for estimating the remaining spectrum pattern of suppressed frequency components, and a signal synthesized from these is added to the target signal. Although this approach is excellent in sound quality improvement, there is a practical problem. Namely, it is necessary for this approach to use a short time Fourier transform process and a short time inverse Fourier transform process which are performed at a high resolution over the broad band of a subject signal, resulting in a large amount of computation required for digital signal processing. This leads to requirements for an excessive calculation amount and an excessive circuit scale of a digital signal processor (DSP), lowering a practical value.

In a recently devised approach which proposes a frequency interpolating device and method, the remaining band components of a signal whose frequency components in a particular band were suppressed are derived by using a band-pass filter or the like, frequency-converted and added to the suppressed band wherein the addition level is properly determined from the spectrum envelope information of the remaining frequency components.

Generally, the short time frequency spectrum pattern of a signal has complicated states and its envelope cannot be said that it changes monotonously and smoothly. Therefore, if the intensities of suppressed band components are estimated only from the envelope information and interpolation is performed in a simple manner, a signal not essentially contained in the original signal may be added or an interpolation signal at an excessive level may be added. In this case, the sound quality is not improved but degraded.

The present invention has been made under the above-described circumstances, and aims at providing a signal interpolating device and method having a high practical value capable of recovering an original signal such as an audio signal of high quality from a signal with a suppressed particular frequency band (e.g., high frequency band) of the original signal, providing a very excellent sound quality in terms of auditory senses, and performing signal processing by relatively small scale digital computation.

DISCLOSURE OF THE INVENTION

In order to achieve the above objective, a frequency interpolating device of the present invention can create approximate suppressed frequency components from an input signal with suppressed frequency components of the original signal in a particular frequency band and can recover auditory characteristics of the original signal. In a fundamental operation of generating the suppressed frequency components from the input signal and adding them to the input signal, the addition level is adaptively set in accordance with the spectrum pattern of the remaining frequency components of the input signal.

Setting the addition level is performed by using a look-up table storing data representative of a correspondence between a plurality of reference frequency spectrum patterns and their addition levels. This look-up table is created in accordance with the auditory test results of a plurality of acoustic signal samples or in accordance with the frequency analysis results of a plurality of acoustic signal samples.

More specifically, the frequency interpolating device of this invention comprises: means for generating an interpolation signal having a frequency component in the suppressed band, from the input signal; means for spectrum-analyzing the input signal to derive a spectrum pattern; comparing means for comparing the derived spectrum pattern with a plurality of reference spectrum patterns registered in advance, and in accordance with a comparison result, selecting an addition level of the created interpolation signal relative to the input signal; and means for adding the created interpolation signal to the input signal at the selected addition level. The comparing means includes a search data table storing data representative of a correspondence between the reference spectrum patterns and the addition levels, the search data table being created in accordance with an auditory test of a plurality of acoustic signal samples.

The means for deriving the spectrum pattern of the input signal outputs a code corresponding to the derived spectrum pattern, the comparing means is made of a memory storing data representative of a correspondence between the reference spectrum patterns and the addition levels, and the code is supplied to the memory as a memory address to output the addition level stored at a memory location indicated by the memory address designated by the code.

In the device of the invention, the input signal is typically a digital audio signal obtained by sampling and quantizing an analog audio signal.

Since the signal interpolating device of this invention is constructed as above, the frequency components essentially contained in the original signal (before the particular band components are suppressed) can be reproduced with high fidelity and can be used for interpolating the suppressed signal. It is therefore possible to recover a signal having a good similarity to the original signal.

In the device of the invention, Fourier transform and inverse transform dealing with a broad band signal and having a high resolution are not necessarily required to process a main signal itself. Namely, according to an approach adopted by the invention, although signal processing is performed by paying attention to the frequency components of a signal, it is not necessarily required to incorporate a process of converting a main signal from a "time domain" to a "frequency domain" (or conversely converting a main signal from the "frequency domain" to the "time domain").

According to the invention, the look-up table for searching an interpolation signal level on the basis of a spectrum pattern is formed by using a large number of input signal samples. It is therefore possible to select a proper interpolation signal level at a high precision and perform a frequency interpolation process at a high precision. According to another aspect of the invention, the look-up table is formed by reflecting the auditory test results of test listeners by using specific reproduction means, so that a very natural reproduction sound quality in terms of auditory senses can be obtained.

As described above, in the frequency interpolating device of the invention, a large physical amount is analyzed in a long time for each signal spectrum, and the look-up table is used which stores data configured in advance by auditory tests of acoustic signals by test listeners. Using the look-up table can therefore simplify the device circuit structure considerably. Accordingly, the frequency interpolating device of the invention can realize all computation processes necessary for digital signal processing only by a one-chip audio DSP so that it has a very high practical value.

BRIEF DESCRIPTION OF THE DRAWINGS

FIG. 7 is a diagram showing an example of a list to be used for creating a look-up table indicating a correspondence between a reference spectrum pattern and a corresponding interpolation level.

EMBODIMENTS OF THE INVENTION

With reference to the accompanying drawings, embodiments of a frequency interpolating device and method of the invention will be described in detail.

Figure 1:
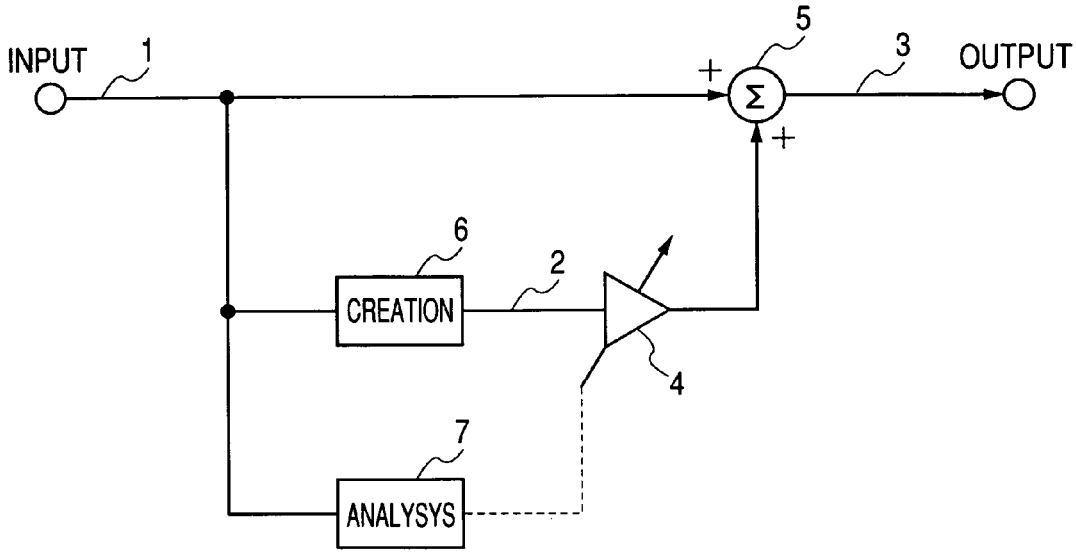
FIG. 1 is a conceptual diagram illustrating a basic function of the invention.

FIG. 1 is a diagram showing a simplified fundamental function of the frequency interpolating device of the invention. In the fundamental operation of the frequency interpolating device of the invention, a signal 1 is input which has suppressed frequency components in a particular frequency band. The frequency components in the suppressed band to be interpolated are created from the input signal 1, and the created signal (interpolation signal) 2 (at a predetermined level) is added to (interpolated into) the input signal 1 to obtain an output signal 3 (which is an approximate signal recovered from the original signal). The level (hereinafter called an interpolation level) of the interpolation signal 2 to be added to (interpolated into) the input signal 1 is adjusted by a variable attenuator 4. The level adjustment by the attenuator 4 is controlled in accordance with the frequency analysis result of the input signal (by a frequency analyzer 7) 1 (or more specifically, in accordance with short time frequency spectrum information of the input signal). The short time spectrum of the input signal 1 changes from time to time. The device of the invention responds to such a change from time to time (dynamic response) and selects an (adaptive) interpolation level suitable for each spectrum pattern. In this context, it can be said that the device of the invention shown in FIG. 1 constitutes a dynamic adaptive system.

Figure 2:
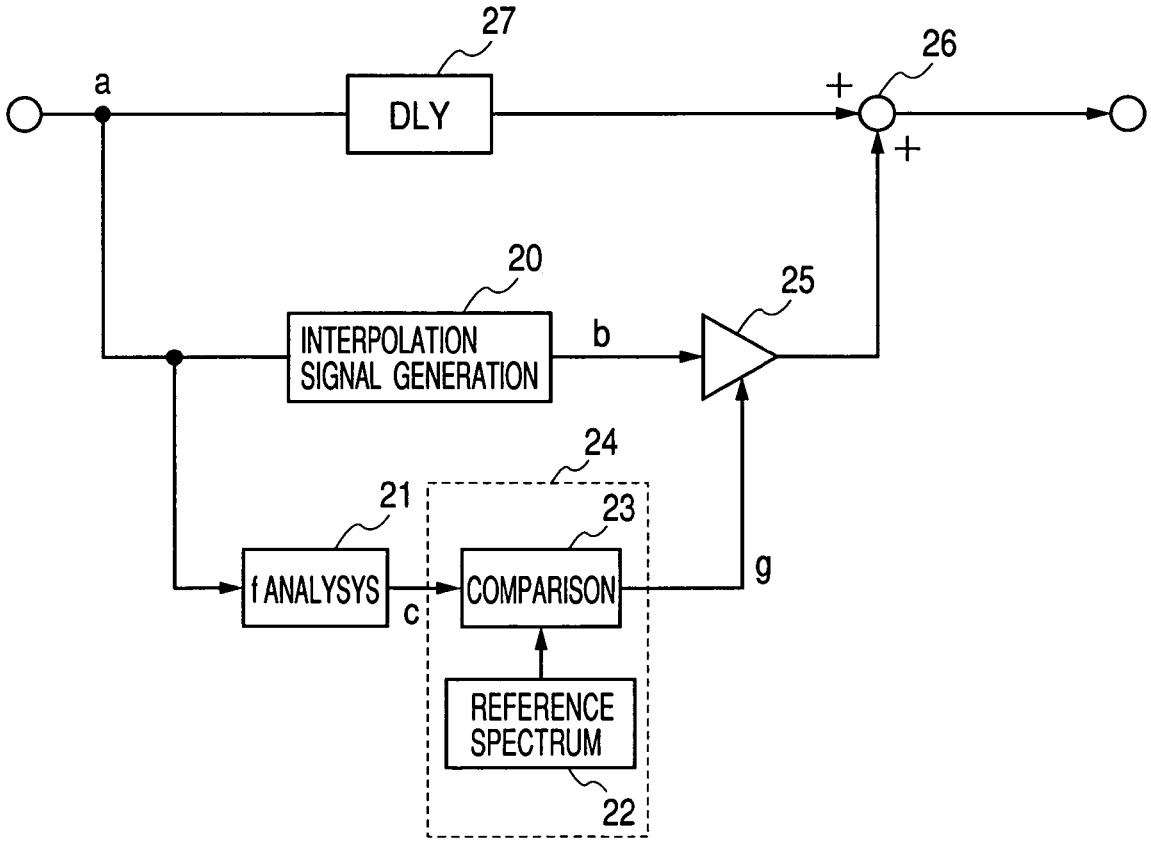
FIG. 2 is a block diagram showing the fundamental structure of a frequency interpolating device of the invention.

FIG. 2 is a block diagram showing a more concrete structure of the frequency interpolating device of the invention. As shown, the device of the invention is constituted mainly of an interpolation signal generating unit 20, a frequency analyzing unit 21, an interpolation level generating unit (constituted of a reference spectrum generator 22 and a spectrum comparator 23) 24, a level adjusting unit 25, an adding unit 26 and a delay unit 27.

In this invention, an input signal a to be frequency-interpolated (by a removed particular frequency band) is input to the interpolation signal generating unit 20 for generating a suppressed band component signal (interpolation signal) to thereby create an interpolation signal b. The input signal a is also input to the frequency analyzing unit 21 to create a signal c representative of the spectrum of the input signal. The created spectrum signal c is patterned and compared with each reference spectrum pattern registered in advance in the reference spectrum generating unit 22. An interpolation level coefficient g is output which indicates the interpolation level corresponding to the associated reference pattern, and supplied to the level adjusting unit 25. The level adjusting unit 25 adjusts the interpolation signal b output from the interpolation signal generating unit 20 to obtain a proper level matching the interpolation level coefficient g, and supplies the adjusted level to the adding unit 26 to be added to the input signal. A recovered signal after interpolation is thus output from the output terminal. The delay unit 27 delays the input signal by a predetermined time in order to compensate for the signal processing time taken for the spectrum pattern comparison. If a signal analysis window time width is relatively long or if the comparison process is performed at high speed, this delay unit 27 is not always required.

Figure 3:
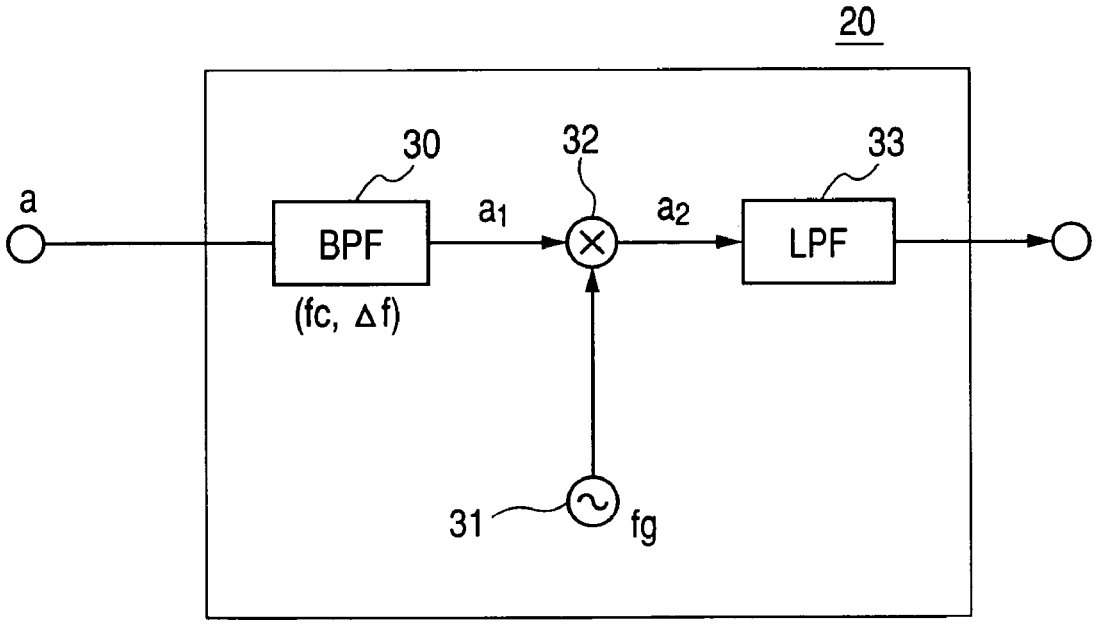
FIG. 3 is a diagram showing an example of an interpolating signal generation unit as a main constituent element of the device shown in FIG. 2.

The particular structure of each constituent element described above will be described sequentially. FIG. 3 shows an example of the structure of the interpolation signal generating unit 20 constituted of a band-pass filter 30, an oscillator 31, a mixer 32 and a low-pass filter 33. The band-pass filter 30 derives from an input signal a frequency component signal (e.g., a signal having a center frequency fc and frequency components in a bandwidth Δf) to be used for interpolation. This derived band component signal $a_1$ is mixed with (multiplied by) a sine wave signal sin(2πfgt) created by the oscillator 31, at the mixer 32 to thereby create a synthesized signal $a_2$ of two signals having the bandwidth Δf and center frequencies $(f_g+f_c)$ and $(f_g-f_c)$. The synthesized signal $a_2$ is passed through the low-pass filter 33 to obtain only the signal having the center frequency of $(f_g-f_c)$. If the frequency $(f_g-f_c)$ is set to a center frequency $f_{int}$ of the suppressed frequency band, a signal in the remaining frequency band $(f_c, \Delta f)$ of the input signal a can be frequency converted into a signal in the interpolation band $(f_{int}, \Delta f)$. It is therefore possible to create a desired interpolation signal for interpolating the suppressed band. In generating the desired interpolation signal, it is obvious that Fourier transform and inverse Fourier transform can be used.

Figure 4:
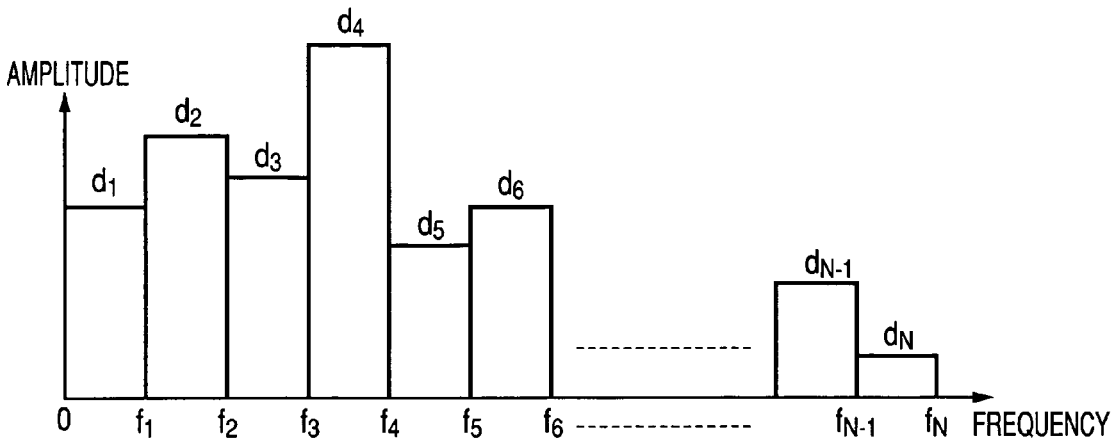
FIG. 4 is a diagram showing an example of the structure of a frequency analyzing unit as a main constituent element of the device shown in FIG. 2.
Figure 4:
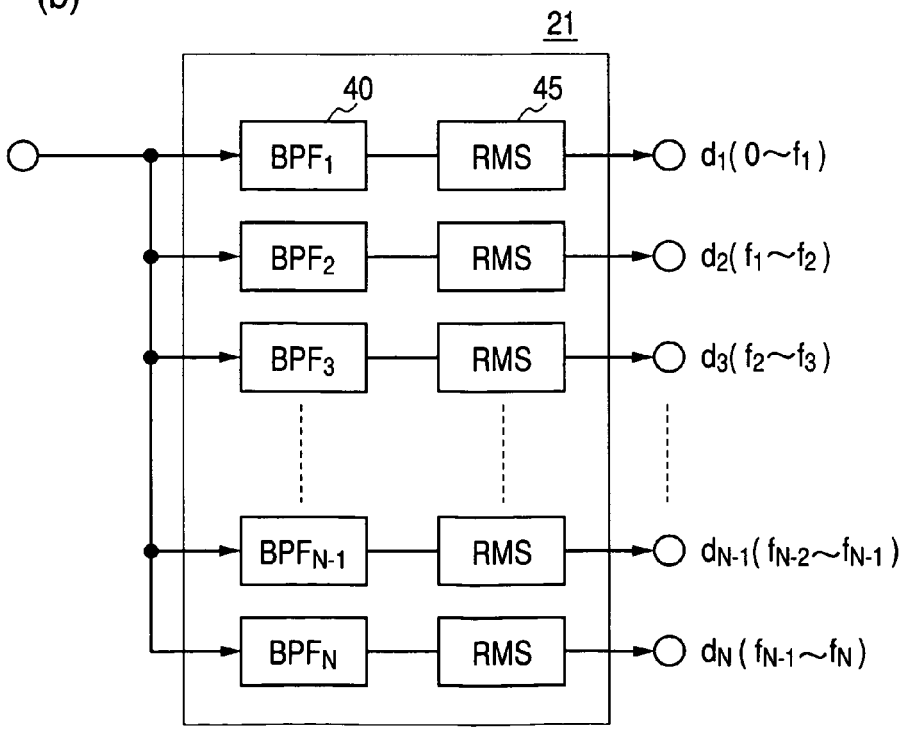

FIG. 4 shows an example of the structure of the frequency analyzing unit 21 constituted of a plurality of pairs (N) of a band-pass filter 40 and an effective value circuit (RMS) 45. With this circuit configuration, a band to be frequency analyzed is divided into N division bands $(F_1, F_2, F_3, \ldots, F_N)$, and an effective value $d_i$ (i=1, 2, . . . , N) of the frequency components in each division band is calculated. It is obvious to adopt a method of obtaining a complex frequency vector $R(\omega)+jI(\omega)$ and calculating $\{R^2(\omega)+I^2(\omega)\}^{1/2}$ by using a Fourier analyzer.

The reference spectrum generator 22 uses a read-only memory (ROM) storing data of spectrum patterns calculated beforehand (a set of amplitude effective values in each division frequency band).

A spectrum pattern represented by effective values in each division band obtained by N-dividing the frequency band to be analyzed can be expressed by a vector having the respective effective values $d_i$ (i=1, 2, 3, . . . , N) as its components. Namely, the spectrum pattern can be expressed by:

$$F_j=(d_{1j}, d_{2j}, d_{3j}, d_{4j}, \ldots, d_{Nj})$$

Figure 5:
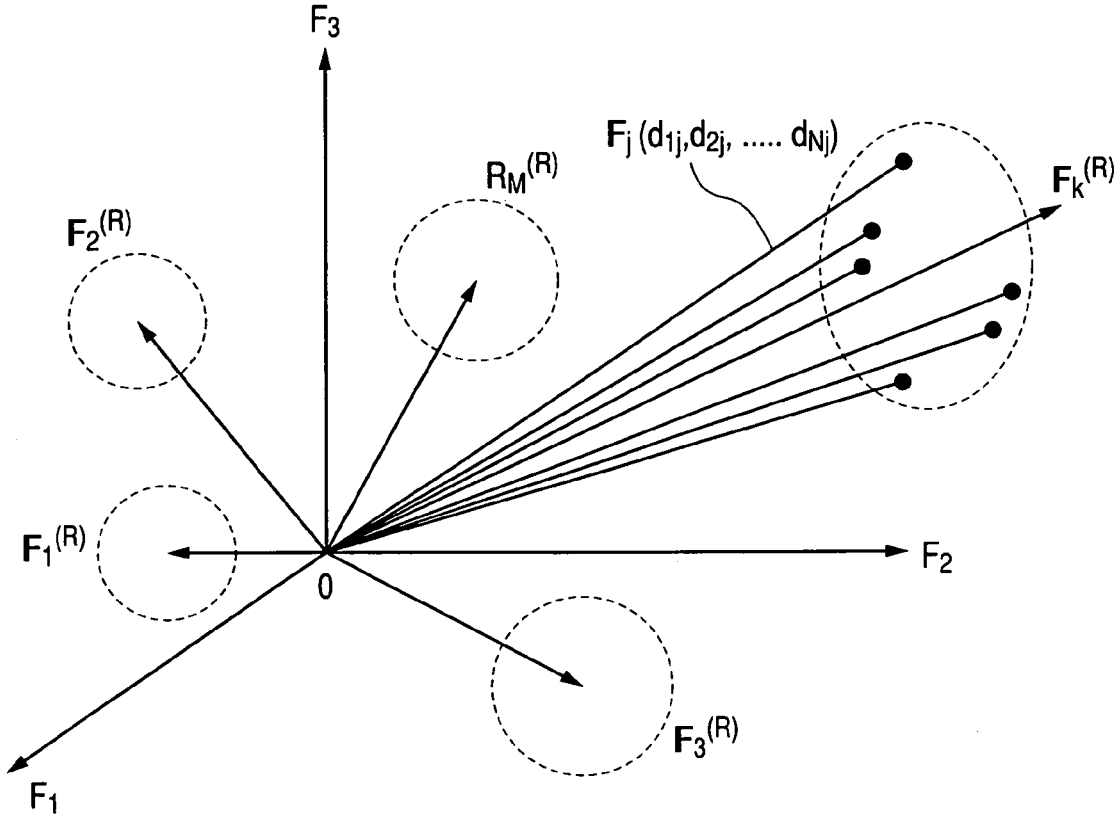
FIG. 5 is a diagram showing a spectrum pattern represented by distribution of N-order vectors.

An optional frequency spectrum pattern (FIG. 4(*a*)) obtained by passing a given signal through the frequency analyzing unit 21 in a predetermined time window (e.g., such as shown in FIG. 4(*b*)) can be represented by N-order vectors disposed in an N-order coordinate space $(F_1, F_2, \ldots, F_N)$. If all spectrum patterns of a given signal, i.e., vectors $F_j=(d_{1j}, d_{2j}, d_{3j}, d_{4j}, \ldots, d_{Nj})$ are disposed in the N-order space, these vectors are not distributed uniformly but they are distributed as clusters as shown in FIG. 5. It is therefore possible to calculate a representative vector $Fk^{(R)}$ of each cluster. According to this invention, such a representative vector $F_k^{(R)}=(d_{1j}^{(R)}, d_{2k}^{(R)}, \ldots, d_{Nk}^{(R)})$ is calculated for many samples of an input spectrum collected beforehand, and the calculated vector is stored in the reference vector generating ROM as the reference vector data.

Figure 6:
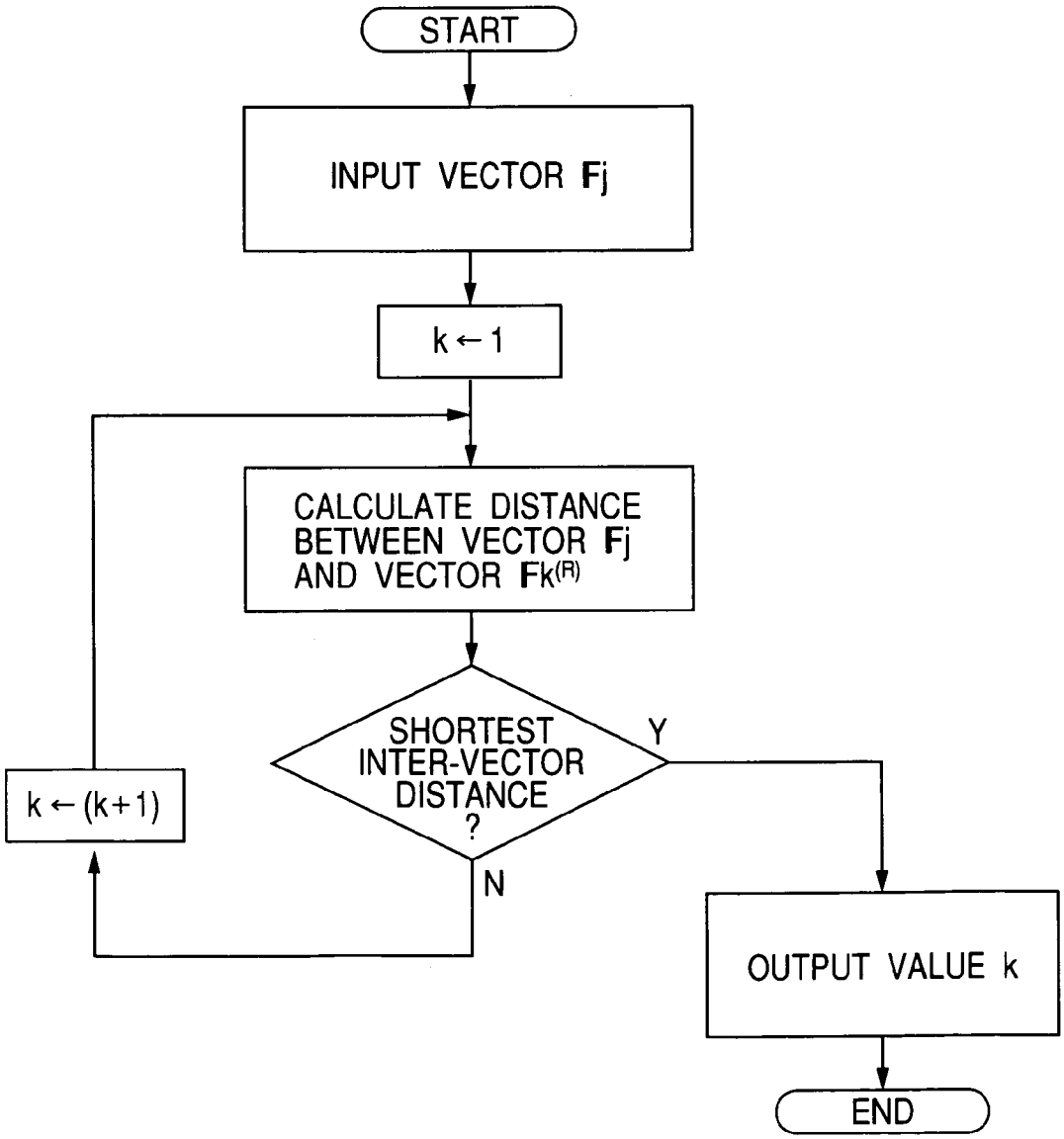
FIG. 6 is a flow chart illustrating a series of processes of comparing an input spectrum pattern with a reference spectrum pattern.

Next, the structure of the spectrum comparator 23 will be described. The spectrum comparator 23 judges whether which one of a finite number of reference spectrum patterns, i.e., reference vectors $F_k^{(R)}(R)=(d_{1k}^{(R)}, d_{2k}^{(R)}, \ldots, d_{Nk}^{(R)})$ (k=1, . . . , M), corresponds to the input spectrum pattern, i.e., an optional input vector $F_j=(d_{1j}, d_{2j}, \ldots, d_{Nj})$ (j=1, . . . , N) (in other words, judges which one belongs to which cluster). More specifically, from the viewpoint of which one of the reference vectors $F_k^{(R)}$ is nearest to the input vector $F_j$, distances are calculated between the given input vector $F_j$ (input vector pattern) and all the reference vectors $F_k^{(R)}$ (reference spectrum patterns) to select the reference vector (spectrum pattern) having the longest inter-vector distance $\delta_{jk}$ (i.e., most similar spectrum pattern). This procedure is illustrated in the flow chart of FIG. 6 showing a sequence of processes for finding the reference vector $F_k^{(R)}$ to which the given input vector $F_j$ belongs. As illustrated in this flow chart, after it is judged which one of the prepared reference spectrum pattern $F_k^{(R)}$ (k=1, . . . , M) belongs to the input spectrum pattern $F_j$, an interpolation level coefficient (as an index for designating the interpolation level) g corresponding to the judged reference spectrum pattern $F_k(R)$ is output.

In this case, there is an issue that what interpolation level is assigned to each reference spectrum pattern $F_k^{(R)}$. This issue is the core of the invention in some sense.

It is assumed in this invention that a preset reference spectrum pattern and a corresponding interpolation level (regarding a relative level at which the interpolation signal is added to an input signal) are determined from the following two methods.

(1) Method Using Auditory Test (1) Acoustic signal samples are collected which are used as references of audio signals (over a number of spectrum patterns) whose particular bands were suppressed.

(ii) A predetermined number of test listeners (having a capability of distinguishing between musical tone qualities) are made to listen to sample sounds under a reference facility and environment to make them judge whether the sound quality and balance in each band are sufficient or not.

(iii) If it is judged insufficient, the test listeners are made to manually move, for example, the variable equalizer such as shown in FIG. 1 to adjust the acoustic signal level.

(iv) While the test listeners are made adjust the volume in the suppressed sound band of each acoustic signal sample for each of a number of spectrum patterns, adjustment levels are collected as interpolation level data. For example, the adjustment level may be "0" (addition of an interpolation signal is unnecessary), "1" (an interpolation signal at its level is added to an input signal), "0.5" (an interpolation signal at its half level is added, "0.25" (an interpolation signal at its ¼ level is added) and the like.

(v) In accordance with the collected interpolation level data, a list is formed representing a correspondence between a reference vector pattern and an interpolation level value, and a reference look-up table (ROM) is created based upon the list.

(vi) If the reference table is required to be changed due to the environment and conditions realized by the reproducing means, a suitable test listener is prepared, and if necessary, specific samples are prepared, to perform fine adjustment in the manner similar to that described above in accordance with the reference table and create the reference look-up table (ROM).

(2) Method Using Frequency Analysis (1) A number of audio signal samples whose particular bands were suppressed are collected and classified into a plurality of spectrum patterns by physical spectrum analysis.

(ii) The correspondence between each classified spectrum pattern and a level of the original sound (before suppression) in a particular suppressed band is analyzed to create a list representative of a correspondence between each spectrum pattern and a level value in the suppressed band which was contained essentially in the original sound.

(iii) In accordance with this correspondence list between the spectrum and interpolation level, a look-up table (ROM) is formed which represents a correspondence between a reference spectrum pattern and an interpolation level value.

FIG. 7 shows an example of a correspondence list between the reference spectrum pattern and interpolation level obtained by the method described above. The contents of this list stored in the reference spectrum pattern ROM include each memory address and corresponding storage data.

Description has been made on a general method of determining an interpolation level by obtaining input spectrum patterns through spectrum analysis of input signals and classifying the patterns into reference spectrum patterns. Next, description will be given for a method of performing more simply the above sequence of operations (frequency analysis→spectrum pattern calculation→interpolation level determination).

Figure 8:
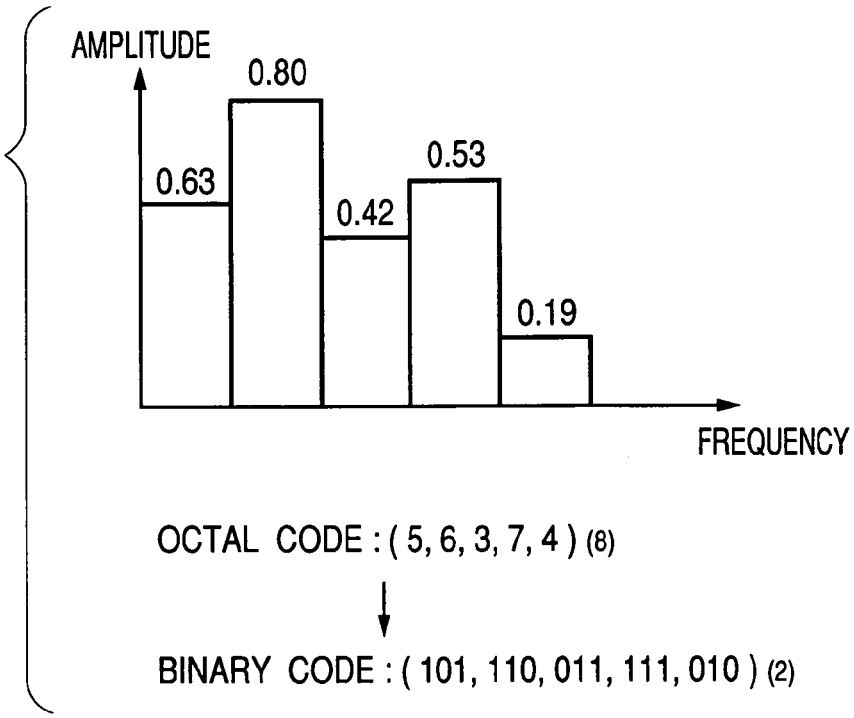
FIG. 8 is a diagram illustrating a simplified method of searching an interpolation level according to an embodiment of the invention.
Figure 8:
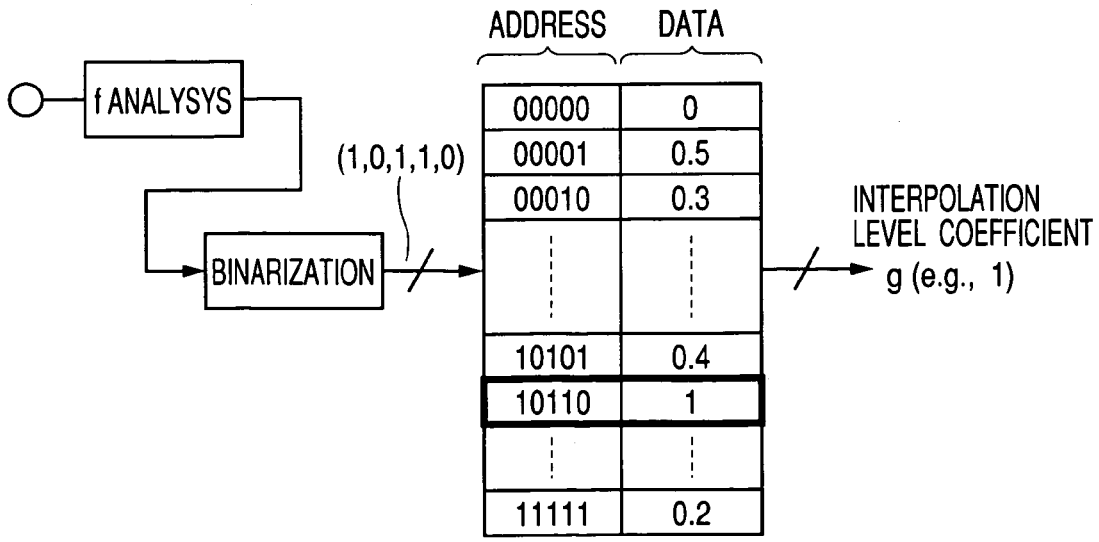

In a method illustrated in FIG. 8, an input spectrum pattern is made discrete and binarized, and by using this binarized data as an address of ROM, the interpolation level coefficient g is obtained as the memory contents. With this method, an input spectrum pattern ($d_{1j}$, $d_{2j}$, . . . , $d_{nj}$) is obtained by using the above-described structure (e.g., the frequency analyzing unit shown in FIG. 4). The effective value $d_{ij}$ (i=1, 2, 2, . . . , N) in each band is normalized, made discrete (e.g., octal values: 1, 2, 3, . . . , N) and binarized. It is assumed for example that an input spectrum pattern $F_j$ in five division bands is given by $F_j$=(0.63, 0.80, 0.43, 0.5, 0.2). This pattern is divided by an ensemble average in each band and made discrete to obtain a discrete spectrum (5, 6, 3, 7, 4). This spectrum is binarized to obtain (101, 110, 011, 111, 100). By using this binary data as address data, it is directly supplied to the memory. This memory stores in advance an interpolation level coefficient (g) corresponding to the binary representation of a spectrum pattern. As the spectrum code is supplied to the memory, the interpolation level coefficient (g) can be obtained immediately as a memory output.

The input spectrum pattern ($d_{1j}$, $d_{2j}$, . . . , $d_{nj}$) may be directly converted into a binarized spectrum which is used as a memory address. For example, this binarization is performed on the basis of whether the level $d_{ij}$ (i=1, 2, 2, . . . , N) is either not smaller than or smaller than the ensemble average in each band. For example, in the above example of the input spectrum pattern $F_j$:(0.63, 0.80, 0.43, 0.5, 0.2), if the ensemble average is given by (0.7, 0.6, 0.5, 0.4, 0.2, 0.01), then a binary spectrum pattern (0, 1, 0, 1, 0) can be obtained.

Similar to the above example, each interpolation coefficient g corresponding to the binary representation is stored in the reference spectrum memory. If the binary spectrum pattern data is directly supplied to the address terminal of the memory, the interpolation level coefficient can be obtained as a memory output. In the example shown in FIG. 8(*b*), a spectrum pattern is binarized to obtain data (1, 0, 1, 1, 0) which is supplied to the memory as a memory address to obtain an interpolation level coefficient g=1.0.

Figure 9:
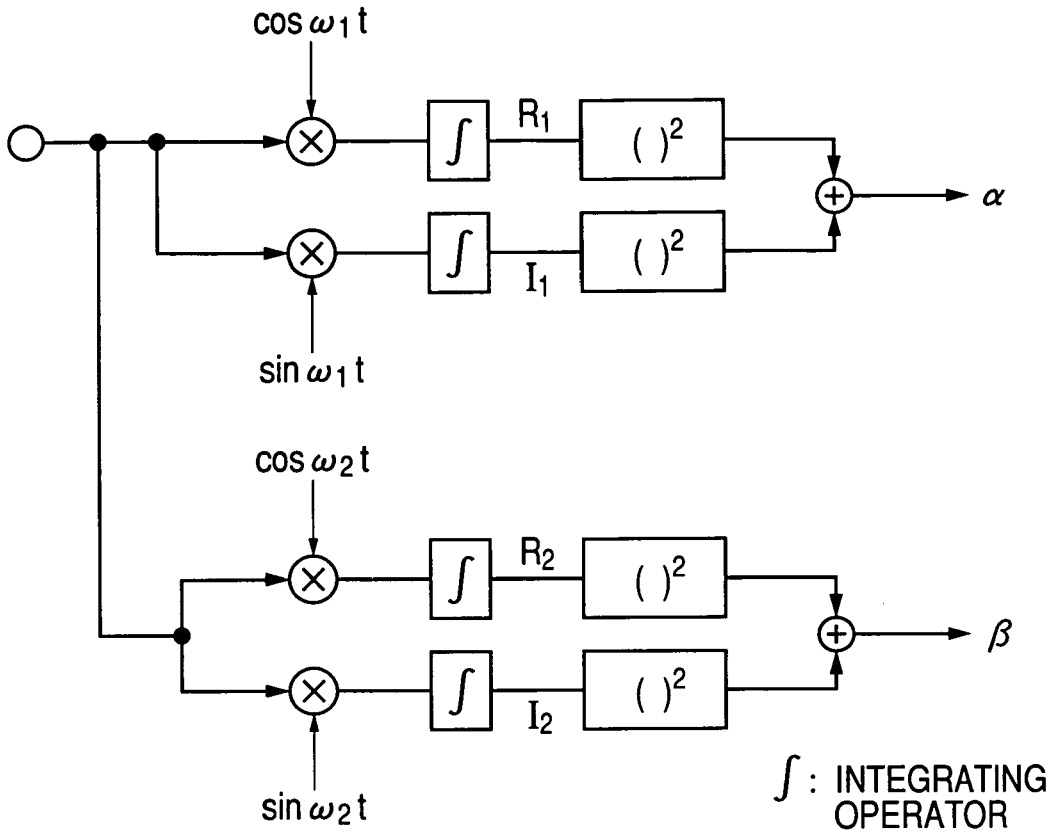
FIG. 9 is a diagram illustrating a simplified method of searching an interpolation level according to another an embodiment of the invention.

As shown in FIG. 9, attention is paid to two specific frequencies (angular frequencies $\omega_1$ and $\omega_2$) of an input signal. Interpolation level coefficients (0 to 1) corresponding to spectra each classified by a pair of amplitude levels ($\alpha$, $\beta$) at the frequencies are stored beforehand in a memory in a matrix shape. Frequency analysis of the two frequencies $\omega_1$, $\omega_2$ is performed by calculating complex Fourier components R and I shown in FIG. 9. A component level $\alpha$ at the first frequency (angular frequency $\omega_1$) and a component level $\beta$ at the second frequency (angular frequency $\omega_2$) are obtained and an interpolation level coefficient g corresponding to ($\alpha$, $\beta$) can be read from the memory.

Figure 10:
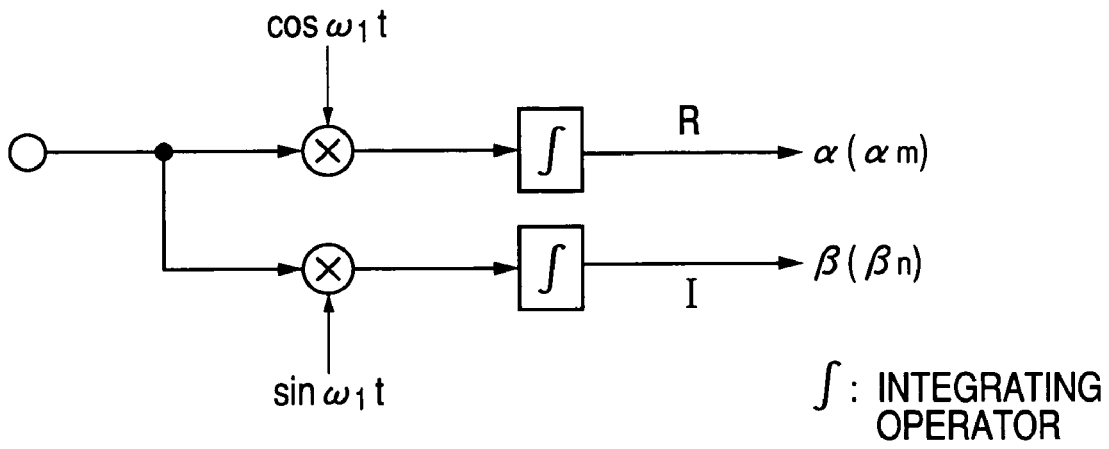
FIG. 10 is a diagram illustrating a simplified method of searching an interpolation level according to still another an embodiment of the invention.
Figure 10:
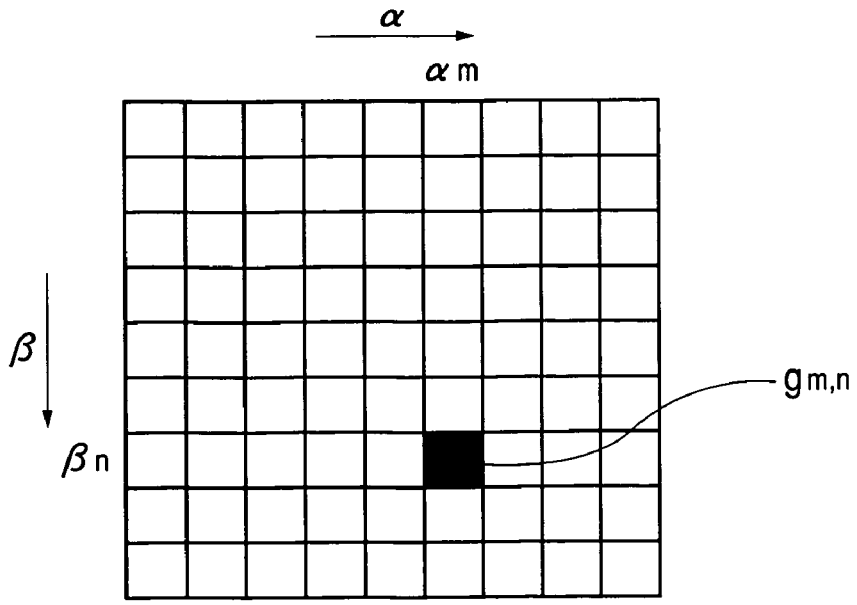

Lastly, in the simplest method illustrated in FIG. 10, only one operator for obtaining a complex Fourier coefficient is used. The real part (R) and imaginary part (I) of output Fourier components are related to a spectrum pattern. With this method, the interpolation level coefficient is read from the memory in accordance with paired data of the real and imaginary parts (R, I). In the example shown in FIG. 10, the memory location is determined directly from the outputs ($\alpha$, $\beta$)=($\alpha_m$, $\beta_n$) and the value $g_{mn}$ is read. Although a precision of similarity to a spectrum pattern is not so good, this method is effective for the case that there is a remaining frequency band (e.g., $\omega_1$) having a strong correlation with the level in the suppressed frequency band. This method is particularly useful in that the circuit structure can be simplified.

INDUSTRIAL APPLICABILITY

It is possible to recover at a good similarity the high frequency components of an audio signal or the like whose high frequency components were suppressed and to synthesize a acoustic signal similar to an original signal. It is therefore possible to reproduce an audio signal having a high quality and a sufficiently broadened high frequency band. According to the techniques of this invention, auditory test result data of an audio signal or the like by test listeners can be reflected upon the device structure so that a very natural reproduction sound quality can be obtained. Since the calculation amount necessary for frequency interpolation digital signal processing is relatively small, the device of a small scale can be used and the cost can be reduced considerably.

What is claimed is:

1. A frequency interpolating device for receiving an input signal obtained by suppressing frequency components in a particular frequency band of a given original signal to narrow an entire frequency bandwidth of the original signal and recovering a signal similar to the original signal by approximately creating the suppressed frequency components, the frequency interpolating device comprising:

means for creating an interpolation signal having frequency components in said suppressed band, by frequency-converting frequency components in a residual frequency band of said input signal;

means for spectrum-analyzing said input signal to extract a spectrum pattern;

comparing means for comparing said extracted spectrum pattern with a plurality of reference spectrum patterns registered beforehand, and on the basis of a comparison result to select an addition level of said created interpolation signal relative to said input signal; and means for adding said created interpolation signal to said input signal at said selected addition level, wherein said comparing means includes a look-up data table storing data representative of a correspondence between said reference spectrum patterns and said addition levels, said look-up data table being created on the basis of an auditory test of a plurality of acoustic signal samples, wherein said means for extracting the spectrum pattern of said input signal operates to output a code corresponding to said extracted spectrum pattern, and said comparing means is made of a memory that stores data representative of a correspondence between said reference spectrum patterns and said addition levels, and wherein said code is inputted to said memory as a memory address to output the addition level stored at a memory location indicated by the memory address designated by said code.

2. The frequency interpolating device according to claim 1, wherein said input signal is a digital audio signal obtained by sampling and quantizing an analog audio signal.

* * * * *